US006398128B1

(12) United States Patent
Hamilton et al.

(10) Patent No.: US 6,398,128 B1
(45) Date of Patent: Jun. 4, 2002

(54) QUICK DISCONNECT NOZZLE ASSEMBLY

(75) Inventors: Richard J. Hamilton, West Chicago; Gerald P. Ferrazza, Schaumburg, both of IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/491,132

(22) Filed: Jan. 26, 2000

(51) Int. Cl.[7] ..... B05B 1/00
(52) U.S. Cl. ..... 239/71; 239/600
(58) Field of Search ..... 239/71, 73

(56) References Cited

U.S. PATENT DOCUMENTS

| | | | | |
|---|---|---|---|---|
| 4,664,314 A | | 5/1987 | O'Brien et al. | |
| 5,143,298 A | | 9/1992 | Prokopoff | |
| 5,190,224 A | | 3/1993 | Hamilton | |
| 5,199,649 A | * | 4/1993 | Tolboll | 239/600 |
| 5,253,807 A | * | 10/1993 | Newbegin | 239/600 X |
| 5,295,506 A | * | 3/1994 | Smith | |
| 5,333,794 A | * | 8/1994 | Haruch | 239/600 |
| 5,421,422 A | | 6/1995 | Bowen | |
| 5,727,739 A | | 3/1998 | Hamilton | |
| 6,079,638 A | * | 6/2000 | Chang | 239/600 X |

* cited by examiner

*Primary Examiner*—Lesley D. Morris
(74) *Attorney, Agent, or Firm*—Leydig, Voit & Mayer, LTD

(57) ABSTRACT

A spraying system having a plurality of spray nozzle assemblies mounted on a common liquid supply header. The spray nozzle assemblies each include a nozzle body fixed to the header and a spray tip secured to the body as an incident to rotation of the spray tip relative to the body. Each spray tip has an elongated discharge orifice adapted for emitting a flat spray pattern and is formed with radial gripping wings in aligned relation to the elongated discharge orifice which enable the user to know the orientation of the discharge orifice, and hence the orientation of the flat discharging spray pattern, prior to start up of a spray operation. The nozzle bodies further each are formed with at least one pair of indicator nibs, which when disposed in longitudinal alignment with the liquid supply header, automatically establishes an orientation of the spray tip elongated discharge orifice at a predetermined relative small angle to the axis of the header so as to avoid impingement of the discharging flat spray patterns of adjacent nozzle assemblies. An alternative embodiment of a spray tip has a slightly modified locking lug design for effecting mounting of the spray tip in the common body with the discharge orifice aligned with the axis of the fluid supply header. Further alternative embodiments include a spray nozzle with a swivel mounted adapter and quick disconnect spray tip, or with an adapter having a screw-in orifice defining insert for the particular spray application.

45 Claims, 8 Drawing Sheets

QUICK DISCONNECT NOZZLE ASSEMBLY

FIELD OF THE INVENTION

The present invention relates generally to spray nozzles, and more particularly, to spray nozzle assemblies having a nozzle body and a spray tip which are coupled by quick disconnect means that permits quick and easy disassembly of the tip from the body for enabling of tip cleaning and/or replacement.

BACKGROUND OF THE INVENTION

Spray nozzle assemblies of the above type which have enjoyed considerable success are disclosed in commonly assigned U.S. Pat. Nos. 5,190,224 and 5,421,522. The spray tip and nozzle body of such assemblies typically have cooperating lugs and stops that establish the predetermined mounted position of the spray tip as an incident of rotational movement, and the tip has an outer gripping portion or wings that enable manual gripping and turning of the spray tip during assembly and disassembly. Since the spray tip is designed for removal and replacement in the nozzle body, it is important that the spray tip is easily accessible to the user. When the spray tips are designed for discharging flat spray patterns, it also is necessary that the spray tip be mountable with the discharge orifice thereof in predetermined orientation with respect to the nozzle body and in a manner that enables the user to determine the spray orifice orientation, and hence, the expected discharge pattern, prior to the spray operation.

It is further desired that the nozzle body of such quick disconnect spray nozzle assemblies be easily mountable in predetermined orientation with respect to a liquid supply pipe or header. This is particularly important in spray installations when a plurality of nozzle assemblies are mounted on a common liquid spray header. In such installations, it is common that the spray tip discharge orifices be oriented at a small angle, such as 10 degrees, to the longitudinal axis of the header so that the flat discharging spray patterns of adjacent nozzles overlap to a small extent in side-by-side relation, without direct impingement on each other.

While various means have been proposed for facilitating mounting of such quick disconnect spray nozzle assemblies in predetermined orientation on a header and for enabling a user to more easily detect the orientation of spray tip discharge orifice, these proposals have not been entirely satisfactory, particularly in industrial installations where access to the nozzle is impeded. Moreover, because the spray tips of the nozzle assemblies commonly include a gripping collar formed with notches in opposed sides thereof that are in radial alignment with the elongated flat spray discharge orifice to provide clearance openings to ensure against interference with the discharging spray, particularly in high volume/capacity spraying, it has been necessary that any radial gripping wings of the spray tip be oriented at an angle to the discharge orifice, which tends to confuse the user with respect to the orientation of the discharge orifice. Spray tip alignment difficulties are compounded when the spray tip is mounted in a ball or swivel type mounting. In addition, the design of camming lugs and stops on the spray tip necessary for effecting predetermined orientation of the discharge orifice can require complex tooling, particularly when the spray tip is manufactured by plastic injection molding. The plastic injection molding tooling further can significantly limit design alternatives in such molded plastic spray nozzle assemblies.

Tooling costs also can be prohibitively expensive for small lot production of spray nozzle assemblies. For example, there are dozens of types of spray tips that can be required for particular spray applications. To design, tool, and manufacture individual spray nozzle assemblies, on a small lot-basis, for each spray application simply is ineconomical. The multiplicity of component parts of spray nozzle assemblies can be compounded further by the need, in many instances as indicated above, for spray nozzle assemblies to direct discharging sprays at a relatively small angle, such as 10 degrees to the common header on which the nozzle assemblies are mounted, while in other instances, to direct the discharging sprays at a different angle, such as 90 degrees to the axis of the common header.

Still further problems can arise in use of such quick connect spray nozzles in particular spray applications. Since it is desirable that the discharge orifices be disposed in recessed relation, axially inwardly, of the gripping wings of the spray tip for protecting the discharge orifice from external contact and damage, the gripping portion may not only impede the discharging liquid spray, but also the flow of air typically drawn into the discharging liquid spray as it emits from the nozzle for enhancing liquid particle breakdown and distribution. While such spray nozzle assemblies also typically are mounted in a manner that directs spray in a downward direction, when the spray nozzle assembly is mounted for directing spray in an upward direction, falling liquid can accumulate in internal pockets of the spray tip and raise to a level that may impede the discharging spray or create unsightly dripping.

OBJECTS AND SUMMARY OF THE INVENTION

It is an object of the present invention to provide a quick disconnect spray nozzle assembly in which the spray tip and the nozzle body include means for ensuring reliable mounting of the nozzle assembly in predetermined angular orientation relative to a liquid supply pipe or header and which enable a user to easily observe the proper orientation of the discharge orifice of the spray tip prior to the spray operation.

Another object is to provide a spray nozzle assembly as characterized in which the spray tip has opposed radial gripping wings which identify the orientation of the discharge orifice, without effecting or impeding the discharging liquid spray.

A further object is to provide a spray tip of the above kind that has gripping wings in aligned relation to the elongated flat spray discharge orifice which neither impedes the discharging liquid spray or the inward flow of ambient air necessary for enhanced liquid particle breakdown and distribution.

Yet another object is to provide a quick disconnect spray nozzle assembly that includes a quick disconnect body effective for receiving and orienting spray nozzles at different predetermined angles with respect to the axis of the header upon which the spray nozzle assembly is mounted.

Still another object is to provide a quick disconnect spray nozzle assembly that includes a common body and adapter that can be economically produced and used with numerous different spray tips for desired spray applications.

A further object is to provide a quick disconnect spray tip for use in a spray nozzle assemblies of the foregoing type which is relatively simple in design and which lends itself to economical manufacture.

A further object is to provide a quick disconnect spray tip having camming lugs and stops oriented in a manner that facilitates injection molding of the part. A related object is to provide a plurality of quick disconnect spray nozzles or tips of the foregoing type in which small variations in the camming lug design enables the spray tips to be mounted in a common nozzle body at a different angular orientations for the particular spray application.

Still another object is to provide a spray nozzle assembly with a quick disconnect spray tip of the foregoing type which can effectively discharge a spray in an upward vertical direction without accumulating liquids that can impede the liquid discharge or create unsightly dripping.

Other objects and advantages of the invention will become apparent upon reading the following detailed description and upon reference to the drawings, in which:

Figure 1:
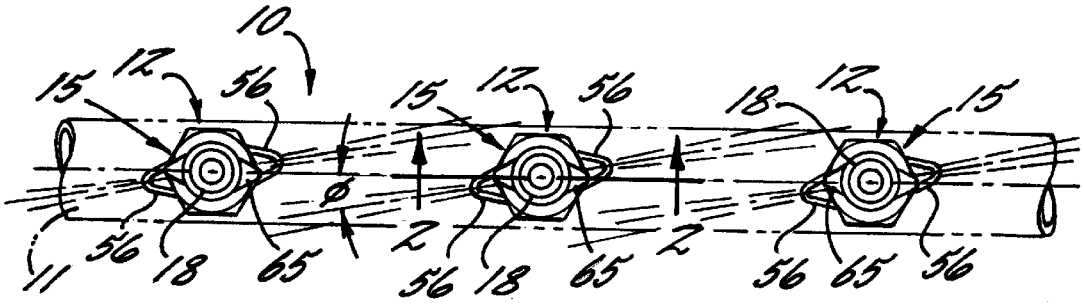
FIG. 1 is a partially diagrammatic top view of a liquid supply header or pipe having a plurality of longitudinally spaced spray nozzle assemblies in accordance with the invention.
Figure 2:
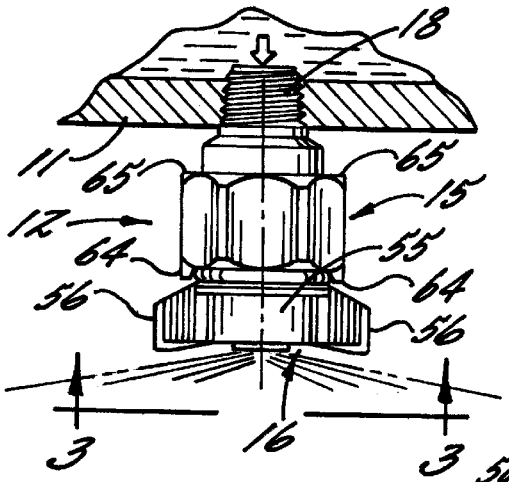
FIG. 2 is an enlarged fragmentary vertical section of one of the spray nozzle assemblies shown in FIG. 1, taken in the plane of line 2—2.
Figure 3:
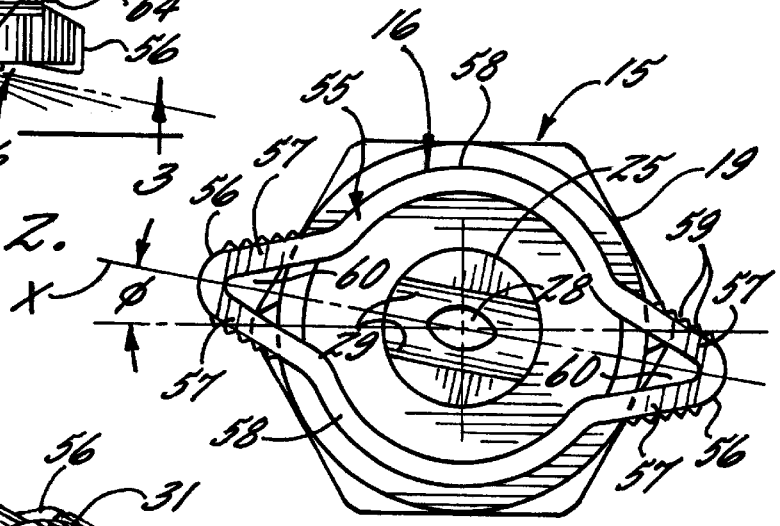
FIG. 3 is an enlarged bottom view of the spray tip of the spray nozzle assembly shown in FIG. 2, taken in the plane of line 3—3.
Figure 4:
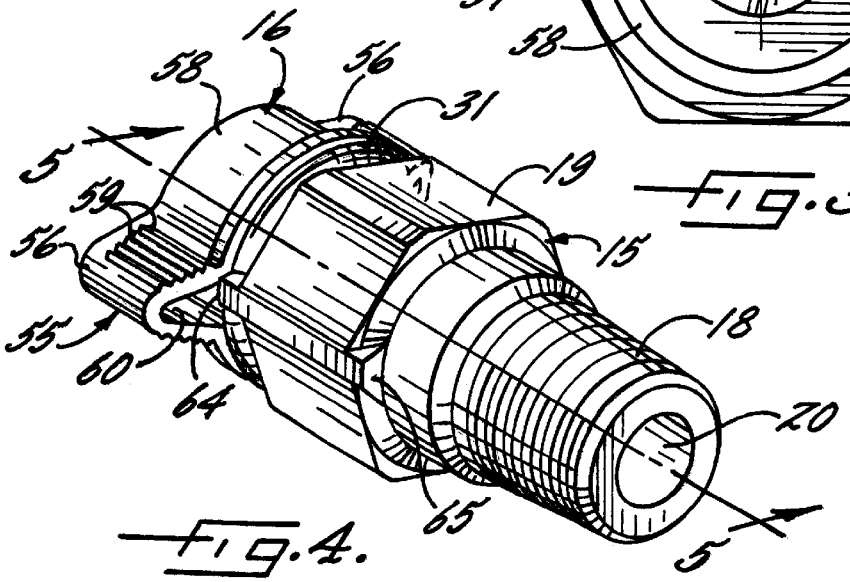
FIG. 4 is a perspective of the illustrated spray nozzle assembly.

While the invention is susceptible of various modifications and alternative constructions, a certain illustrative embodiment thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawings, there is shown an illustrative spraying system 10 which includes a liquid supply header or pipe 11 having a plurality of spray nozzle assemblies in accordance with the invention mounted in longitudinally spaced relation along the header 11. In certain respects, the spray nozzle assemblies 12 are similar to those disclosed in Hamilton U.S. Pat. No. 5,727,739, the disclosure of which is incorporated herein by reference. Since each of the spray nozzle assemblies is identical in construction, only one will be described in detail.

Each spray nozzle assembly 12 basically comprises a spray nozzle body 15 and a replaceable spray tip or nozzle 16. The nozzle body 15 and spray tip 16 both preferably are formed of a suitable chemically resistant plastic material that may be produced by injection molding in high capacity production equipment. The nozzle body 15 in this instance has an upstream end portion formed with external threads 18 for connecting the nozzle body 15 to the header 1l. A hexagonal forward portion 19 of the body 15 enables a wrench to be applied to the nozzle body 15 to tighten the body to the header 11. The interior of the nozzle body 15 has a fluid passageway defined by an internal bore 20. Downstream of the bore 20, the body 15 is formed with an enlarged annular chamber 21 for receiving an upstream end portion 22 of the spray tip 16.

The upstream end portion 22 of the spray tip 16 is formed with an internal fluid passageway bore 24 aligned with the internal fluid passageway bore 20 of the nozzle body 15. The spray tip 16 further includes a forward conduit portion 25 that defines a reduced diameter bore 26 that communicates with the bore 24 and terminates at a forward end with a spray orifice 28, in this instance defined by a V-shaped cut in the forward end of the conduit portion 25 so as to form a generally elongated outlet with diverging sides 29 for producing a diverging flat spray pattern.

In order to seal the nozzle body chamber 21 from the outside environment, the spray tip 16 has a pair of sealing members 30, 31 in the form of annular O-rings disposed in respective, longitudinally spaced external grooves 34, 35 of the spray tip 16 in a manner similar to that shown in the above referenced U.S. Pat. No. 5,727,739. The nozzle body 15 and spray tip 16 also are formed with cooperating camming elements which cause the spray tip 16 to be drawn axially into the nozzle body 15 when the spray tip 16 is inserted endwise into the body and then rotated relative to the nozzle body 15. As an incident thereto, the sealing member 30 is compressed between the outside of the spray tip 16 and the inside of the nozzle body 15 to establish a first seal and the sealing member 31 is forced against the end of the nozzle body 15 to establish a second seal between the spray tip and nozzle body.

Figure 5:
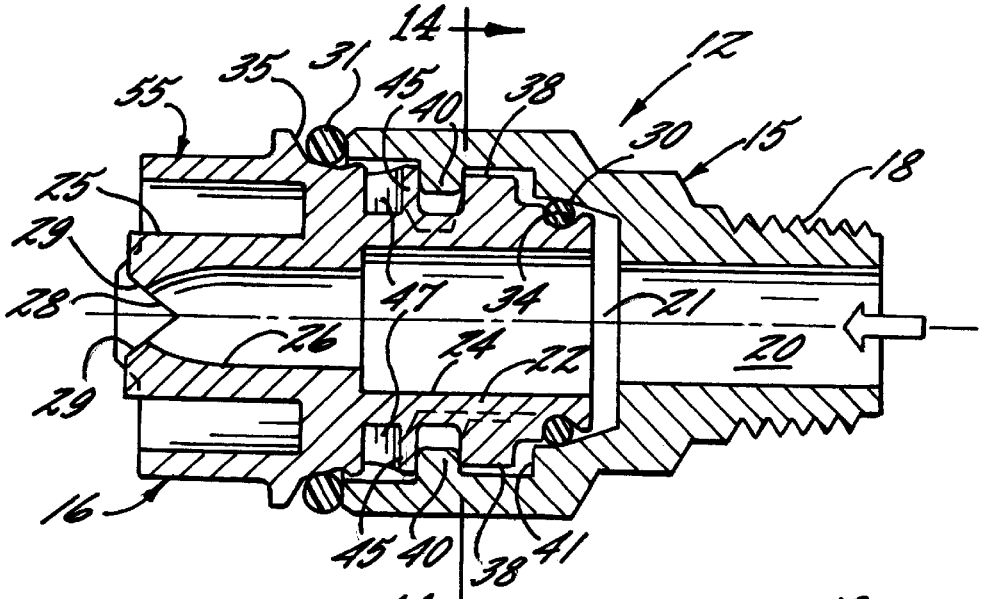
FIG. 5 is an enlarged longitudinal section of the spray nozzle assembly shown in FIG. 4, taken in the plane of line 5—5.

More particularly, the camming elements of the spray tip 16 are formed by a pair of outwardly extending and diametrically opposed camming lugs 38 which are molded integrally with the upstream end portion 22 of the spray tip 16. When the spray tip 16 is initially inserted into the nozzle body 15, the tip is oriented such that the lugs 38 are aligned angularly with a pair of diametrically opposed notches 39 in the body. The notches 39 are defined between adjacent ends of a pair of diametrically opposed camming lugs 40 molded integrally with and projecting inwardly from the body 15. The camming lugs 40 are spaced forwardly from an axially facing shoulder 41. (FIGS. 5 and 6) of the body and thus a slot 42 is defined between the shoulder and each lug 40.

Figure 9:
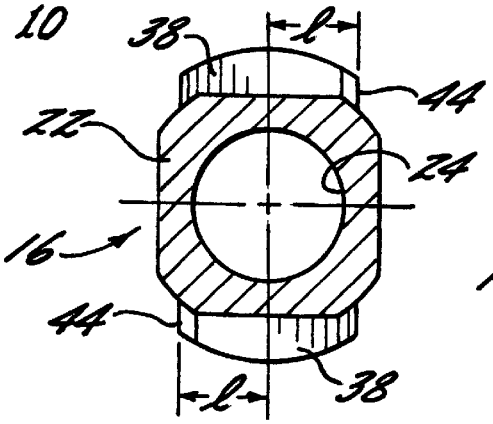
FIG. 9 is a cross section view of the spray tip, illustrating the arrangement of the spray tip locking and camming lugs, taken in the plane of line 9—9 in FIG. 7.

With the foregoing arrangement, the lugs 38 on the tip 16 are initially aligned with the notches 39 in the body 15 and pass through such notches when the tip is inserted into the nozzle body. Once the lugs 38 pass through the notches 39 and clear the lugs 40, the spray tip 16 may be turned clockwise through approximately one-quarter of a turn to cause the lugs 38 to enter the slots 42. Opposing camming faces of the lugs 38, 40 are angled so as to produce a camming action drawing the tip axially into the body as the tip is turned in a clockwise direction. An end or stop wall 43 (FIGS. 11–14) is formed integrally with the nozzle body at one end of each slot 42 and projects radially inwardly from the body to close off the end of the slot. Engagement of respective stop or side faces 44 of the lugs 38 (FIGS. 7–9) with the end or stop walls 43 limits clockwise turning of the spray tip 16 exactly to one-quarter turn.

To releasably retain the spray tip 16 in assembled relation in the nozzle body 15, the spray tip 16 and body 15 are formed with cooperating detents similar to those shown in the referenced U.S. Pat. No. 5,727,739. More specifically, the spray tip 16 is formed with two detents 45 on diametrically opposed sides of the spray tip 16 each being in the form of a transversely extending strip or rib of plastic extending from a shoulder 46. By virtue of the curvature of the ribs 45, a space 47 is defined between the shoulder 46 and a concave side of the rib 45 for enabling the rib 45 to flex resiliently when axial forces are exerted. The detents in the nozzle body 15 are in the form of recesses or pockets 50 (FIGS. 11–13), complementary in shape to the ribs 45, molded in the downstream sides of the camming lugs 40.

As the spray tip 16 is turned clockwise to cause the spray tip lugs 38 to cam against the nozzle body lugs 40, the ribs 45 are drawn into pressing engagement with the downstream sides of the lugs 40 and are flexed toward the shoulder 46 as permitted by the space 47. As the spray tip 16 reaches its fully installed position, the ribs 45 move into angular alignment with the nozzle body pockets 50 and pop resiliently into the pockets 50 so as to releasably retain the spray tip against counterclockwise turning. When the spray tip 16 is to be turned counterclockwise prepatory to removing the spray tip from the body 15, the leading end portion of each rib 45 is cammed by the adjacent curved end of the respective pocket 50 and is flexed out of the pocket. The spray tip 16 thus is released for turning the lugs 38 into alignment with the notches 39, which permit endwise removal of the spray tip from the nozzle body.

To facilitate gripping and turning of the spray tip 16, the spray tip 16 has an outer gripping portion 55 extending in surrounding, outwardly-spaced relation to the conduit portion 25. The gripping portion 55 is an integrally formed forwardly extending part of the spray tip 16 and comprises a pair of radially extending gripping wings 56 on diametrically opposed sides thereof designed to maximize turning torque. The gripping wings 56 are interconnected by cylindrical side walls 58 also disposed on diametrically opposed sides of the conduit portion 25.

In accordance with an important aspect of the invention, the gripping wings are in radially aligned relation to the elongated discharge orifice of the spray tip so as to indicate and enable a user to know the orientation of the discharge orifice, and hence the orientation of the flat discharging spray pattern, prior to the start of a spraying operation. To this end, in the illustrated embodiment, the gripping wings 56 have a V-shape, as viewed in FIGS. 6 and 10, with a long transverse axis X of the discharge orifice extending through the apexes of the V-shaped gripping-wings 56. The gripping wings 56 in this case are formed with external, vertical ridges 59 to facilitate gripping. It will be seen that since the wings 56 are in radial alignment with the elongated discharge orifice 28, the orientation of the discharge orifice 28 will be readily apparent to the user even when the discharge orifice is not easily accessible for viewing.

Figure 10:
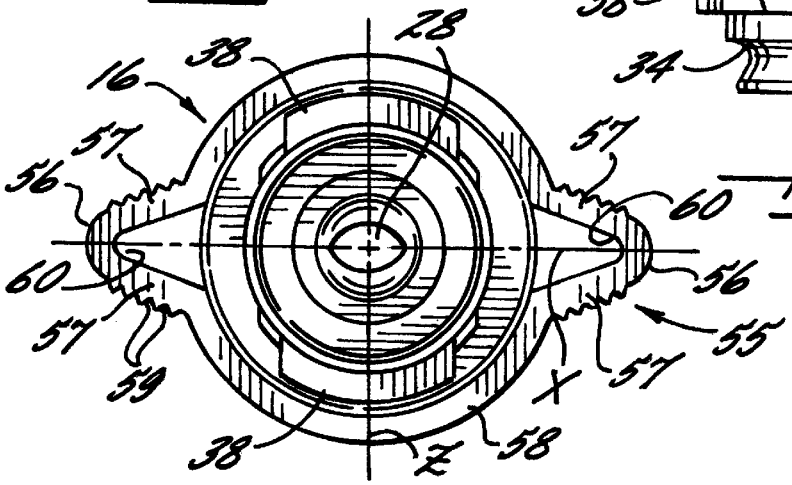
FIG. 10 is a bottom end view of the spray tip shown in FIG. 7, taken in the plane of line 10—10.
Figure 11:
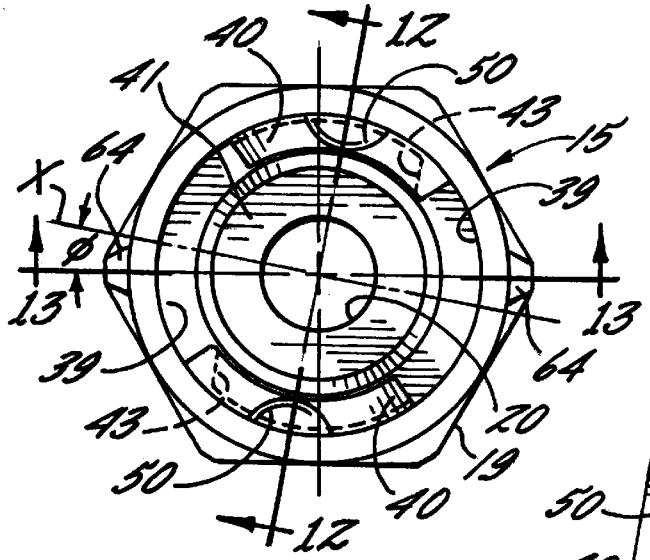
FIG. 11 is a top plan view of the nozzle body shown in FIG. 6.
Figure 12:
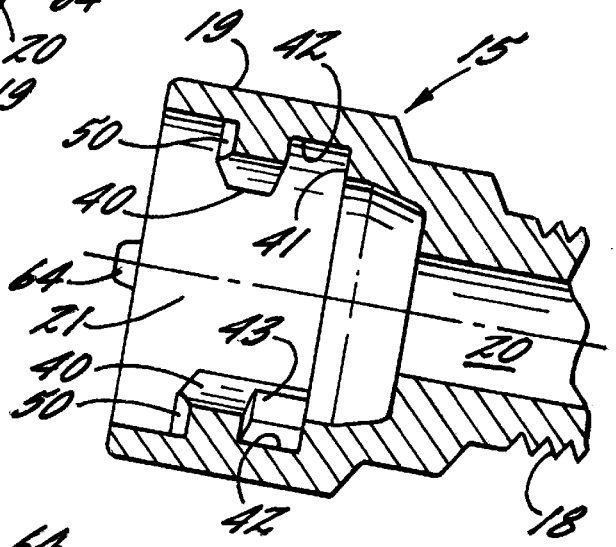
FIGS. 12 and 13 are longitudinal sections of the nozzle body shown in FIG. 11, taken in the plane of lines 12—12 and 13—13 respectively.
Figure 13:
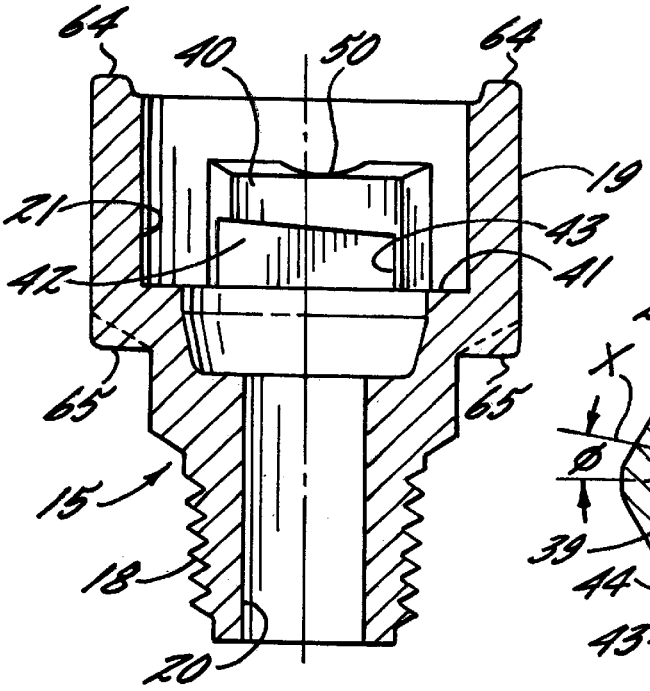

In carrying out a ether feature of the invention, the gripping wings 56 have hollow constructions which define diametrically opposed clearance openings 60 for the unencumbered passage of the flat discharging spray pattern. In the illustrated embodiment, the gripping wings 56 and cylindrical side walls 58 of the gripping portion 55 have a substantially uniform, relatively thin walled thickness, as shown in FIG. 10. Converging sides 57 of the gripping wings 56 each define a V-shaped internal hollow area or opening 60 (FIG. 7) in longitudinal alignment with the elongated discharge orifice 28 so as to enable outer edges of the discharging flat spray pattern, even during high volume/capacity spraying, to exit the spray nozzle without interference with the gripping wings 56.

Figure 7:
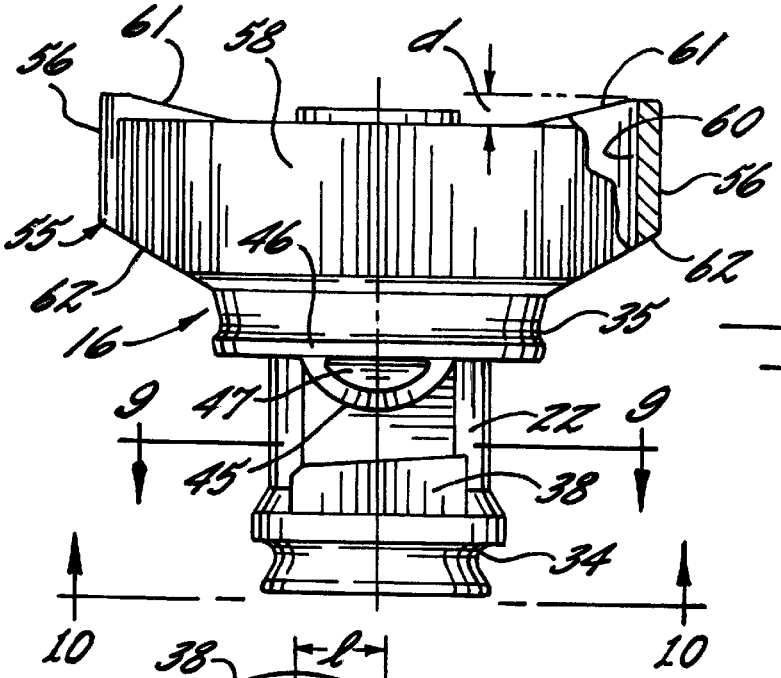
FIG. 7 is a front elevational view of the spray tip of the spray nozzle assembly shown in FIG. 6.
Figure 8:
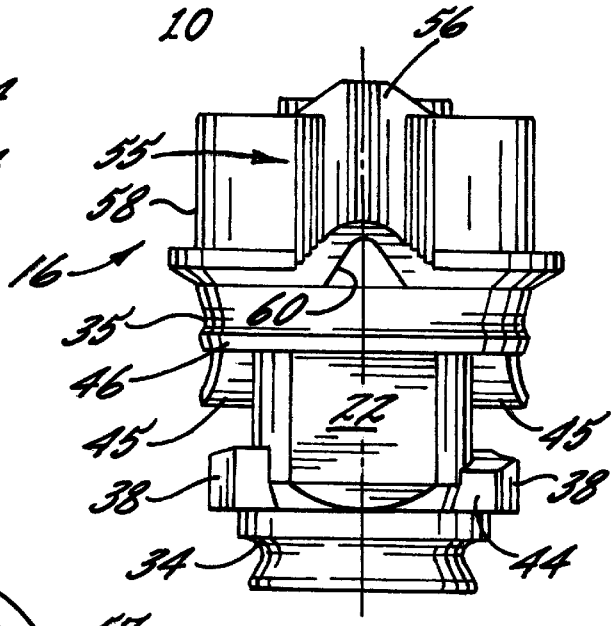
FIG. 8 is a side elevational view of the spray tip of the spray nozzle assembly shown in FIG. 6.

In order to provide protection to the discharge orifice 28 of the spray tip due to engagement from external objects or the like, the gripping wings 56 in this case are tapered in a forward direction, as viewed in FIG. 7, a distance "d" beyond the axial end of the conduit portion 25 in which the discharge orifice 28 is formed. In the illustrated embodiment; the gripping wings 56 have forwardly tapered forward and rearward sides 61, 62, respectively, which further serve to position the gripping wings 56 a slight distance forwardly of the nozzle body 15 for easier access and turning.

In keeping with a further feature of the invention, the clearance openings 60 defined by the gripping wings 56 extend axially through the gripping wings to define flow passages parallel with the axis of the spray nozzle assembly, which enable the axial flow of ambient air through the spray tip 16 as an incident to spraying for enhanced liquid particle breakdown and distribution. In the illustrated embodiment, the cylindrical walls 58 of the spray tip gripping portion 55 are integrally formed and extend axially from a central body portion of the spray tip 16. The V-shaped gripping wings 56, on the other hand, extend outwardly in cantilever-fashion from the cylindrical side walls 58 and from the spray tip body so as to define the V-shaped openings or passages 60 on diametrically opposed sides of the spray tip and the discharge orifice 28 therein. In use, and particularly during high velocity/capacity spraying, air will be drawn in through the passages 60 as an incident to the velocity of the discharging spray for enhancing the spray performance even in industrial environments where space may be congested.

In carrying out still a further aspect of the invention, the spray nozzle assemblies 12 alternatively may be mounted on the header 11 for upward vertical spraying without the spray tips 16 accumulating falling liquid which may impede the discharging spray pattern or create unsightly dripping. It will be understood that with the spray tip 16 oriented in an upward direction, the space between the gripping portion 55 and the conduit portion 25 of the spray tip define an area within which liquid can fall. The passages 60 through gripping wings further define liquid flow passages or openings so as to prevent the accumulation of liquids within the spray tip.

As is known in the art, it is often desirable to mount the spray nozzle assemblies 12 on the common header or supply pipe 11 with the discharge orifices 28 of the individual nozzles oriented for discharging flat spray patterns at a small angle, such as about 10 degrees, to the longitudinal axis of the liquid supply header 11 such that the discharging flat sprays of adjacent nozzle assemblies will not directly impinge upon each other. As can be seen in FIG. 1, the orientation of the gripping wings 56, enables the operator to easily observe the orientation of the discharge orifices, even in congested areas where the discharge orifice is not directly visible.

In further carrying out the invention, the nozzle bodies 15 of the spray nozzle assemblies 12 are formed with indicators which, when longitudinally aligned with the supply pipe or header 11, automatically establish the orientation of spray tip discharge orifices 28 at a common predetermined, relatively small angle, such as 10 degrees, to the header 11. In the illustrated embodiment, the nozzle bodies 15 each are formed with indicator nibs 64, 65 at top and bottom ends of the hexagonal forward body portion 19, respectively. The interlocking camming lugs 38, 40 of the nozzle body 15 and spray tip 16 are designed such that when the nozzle body 15 is mounted with the nibs 64, 65 in longitudinal alignment with the header 11, the assembled spray tip 16 will be oriented with the discharge orifice 28 at an angle of 10 degrees to the header, as shown, when the lug stop faces 44 engage the body stop walls 43. Hence, mounting of the nozzle bodies 15 on the header 11 with the indicator nibs 65, 65 in longitudinal alignment with the header 11 will automatically establish the necessary predetermined angular orientation of the spray tip discharge orifices 28 with respect to the header, which is easily observable by virtue of the orientation of the spray tip gripping wings 56.

Figure 6:
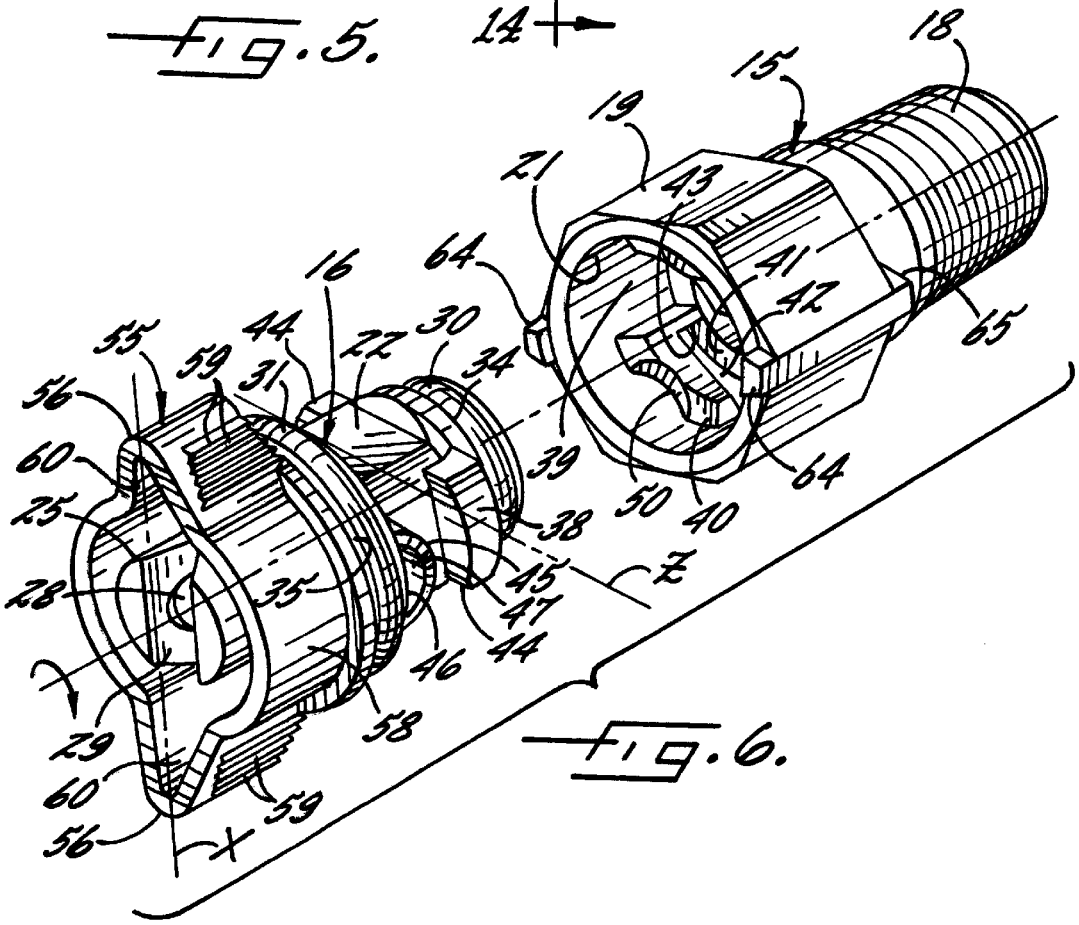
FIG. 6 is an exploded perspective of the spray nozzle assembly shown in FIG. 5.

In carrying out still a further feature of the invention, the spray tip gripping wings 56 are disposed in perpendicular or 90 degree offset relation to camming lugs 38 and detents 45 to facilitate injection molding. With the gripping wings 56 aligned with an X axis extending transversely through the spray tip, as shown in FIG. 6, the spray tip locking lugs 38, including the stop faces 44, extend parallel to a Z axis of the spray tip, as depicted in FIGS. 6 and 110. It will be understood by one skilled in the art that such perpendicular orientation of the protruding spray tip locking lugs and gripping wings enables the plastic injection mold to be pulled apart following a mold operation without part interference. Hence, in practice, the spray tip may be economically produced as an expendable part so as to enable regular spray tip replacement as the need arises. For reasons set forth in the above-referenced U.S. Pat. No. 5,727,739, since the flexible detents 45 are on the spray tip, each replacement of a used spray tip 16 with a new tip results in a nozzle assembly with a new flexible detent with good detent feel to the user.

While, as shown above, the spray nozzle assembly 10 is adapted for automatically orienting the spray tip X axis, and hence, the discharge orifice 28, at a predetermined relatively small angle to the axis of the liquid supply header 11 as an incident to mounting the spray tip 16 in the nozzle body, it sometimes is desirable to mount the spray tips at different angles with respect to the liquid supply header, such as for right angle spraying. Heretofore, individualized designs of spray nozzle assemblies for different spray applications have been relatively costly to tool and manufacture.

In accordance with a further feature of the invention, the nozzle body is adapted for receiving spray tips having the locking lugs of a first design, as indicated above, which orient the spray tip X axis and discharge orifice at a relatively small angle to the longitudinal axis of the liquid supply header, and alternatively, for receiving and mounting spray tips having locking lugs of a slightly modified or second design adapted for orienting the spray tip X axis parallel to the liquid supply header, in order that a spray is discharged at a different angle to the header axis, such as 90 degrees. With reference to FIGS. 15–20, there is shown a spray nozzle assembly having a nozzle body 15 identical to the nozzle body described above, and a spray nozzle 66, which in this case, is effective for a discharging a hollow cone whirl spray pattern in a direction perpendicular to the longitudinal axis of the header 11 upon which the nozzle body 15 is mounted. As in the foregoing embodiment, the nozzle body 15 is mounted on the header 11 with the indicator nibs 64, 65 thereof in longitudinal alignment with the header 11.

Figure 17:
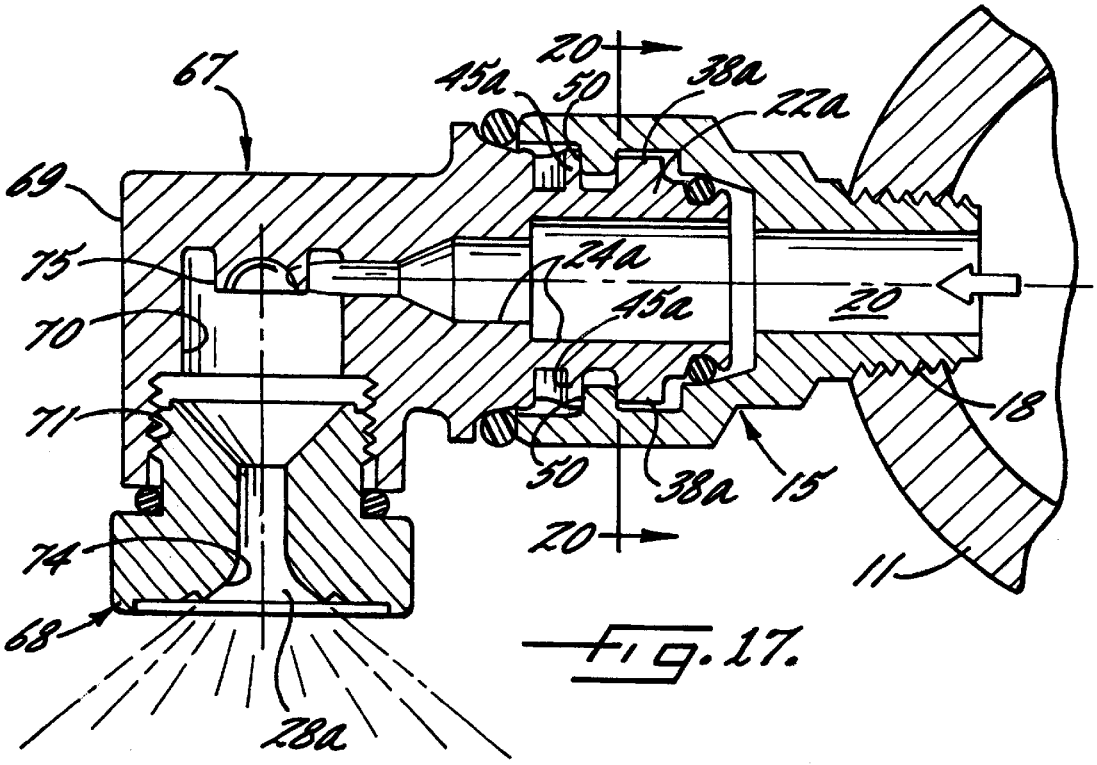
FIG. 17 is an enlarged longitudinal section of the spray nozzle assembly shown in FIG. 15, taken in the plane of line 17—17.
Figure 18:
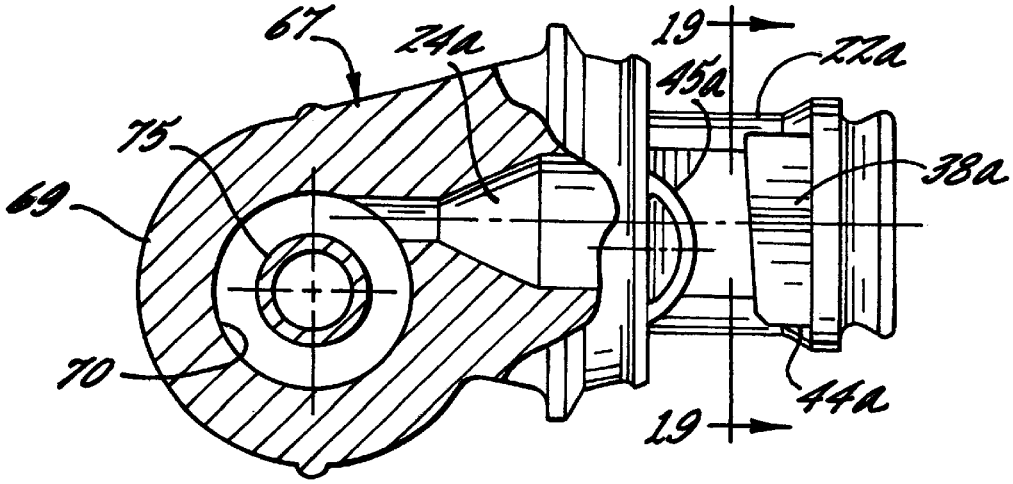
FIG. 18 is an enlarged top plan view, partially in section, of the spray tip adapter included in the spray nozzle assembly shown in FIG. 15.

The spray nozzle 66 in this case has a two part construction comprising a quick disconnect adapter 67 and an orifice cap or insert 68, as depicted in FIG. 17, wherein components similar to those described above have been given similar reference numerals with the distinguishing suffix "a" added. The quick disconnect adapter 67 has an upstream portion **22*a* formed with an internal fluid passageway bore 24*a* aligned with the internal fluid passageway bore 20 of the nozzle body 15. The adapter 67 further includes a forward portion 69 formed with a whirl chamber 70 communicating tangentially at a right angle with the fluid passageway bore 24*a*. The forward adapter portion 69 has an internally threaded end 71 for receiving the threaded end of the orifice cap 68, which is formed with a discharge orifice 28*a* in axial communication with the whirl chamber 70. The discharge orifice 28*a* of the illustrated cap 68 includes an outwardly curved wall section 74 extending outwardly from the whirl chamber 70, which may vary according to the spray configuration desired. The adapter 67 has an integrally formed upstanding post 75 extending from the bottom of the whirl chamber 70 for guiding liquid introduced into the whirl chamber 70**, as is known in the art.

Figure 19:
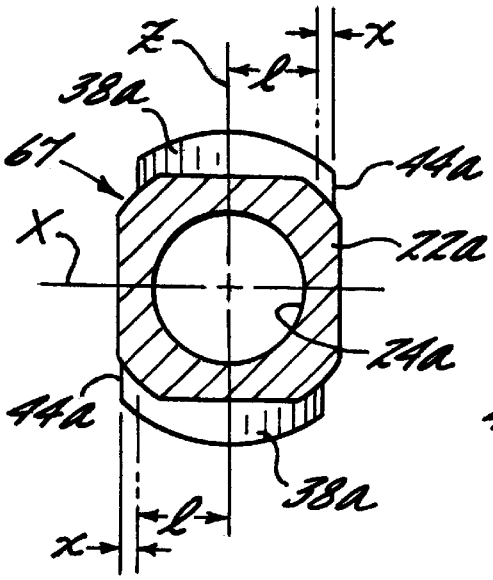
FIG. 19 is a transverse section of the spray tip adapter, illustrating the locking lugs thereof, taken in the plane of line 19—19 in FIG. 18.

To facilitate quick disconnect mounting of the adapter 67 in the body 15, the upstream end portion 22*a* of the adapter is formed with pairs of outwardly extending and diametrically opposed camming and locking lugs 38*a*, and detents 45*a*, which similar to the camming lugs 38 and detents 45 of the spray tip 16 described above, are designed to be inserted into the nozzle body 15 and rotated into locking engagement with the nozzle body. Similar to the spray tip 16, the locking lugs 38 have stop faces 44*a*, extending parallel to a Z axis of the mounting end portion 22*a* of the adapter, as shown in FIG. 19.

Figure 20:
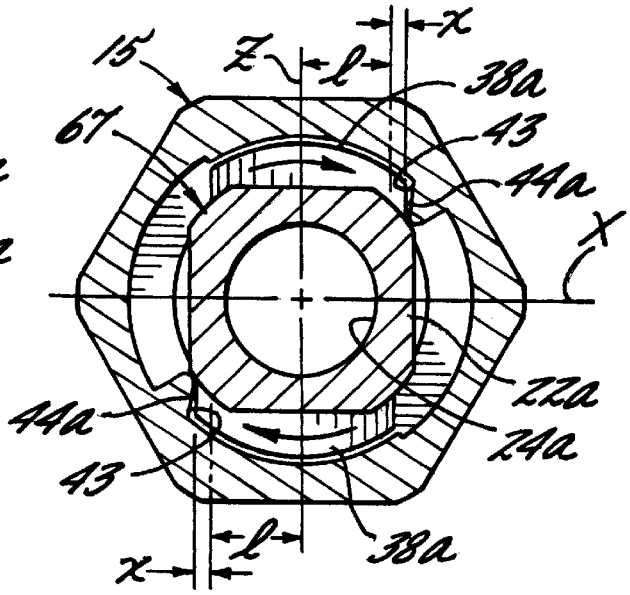
FIG. 20 is a transverse section illustrating engagement of the spray tip adapter locking lug surfaces with the nozzle body, taken in the plane of line 20—20 in FIG. 17.
Figure 21:
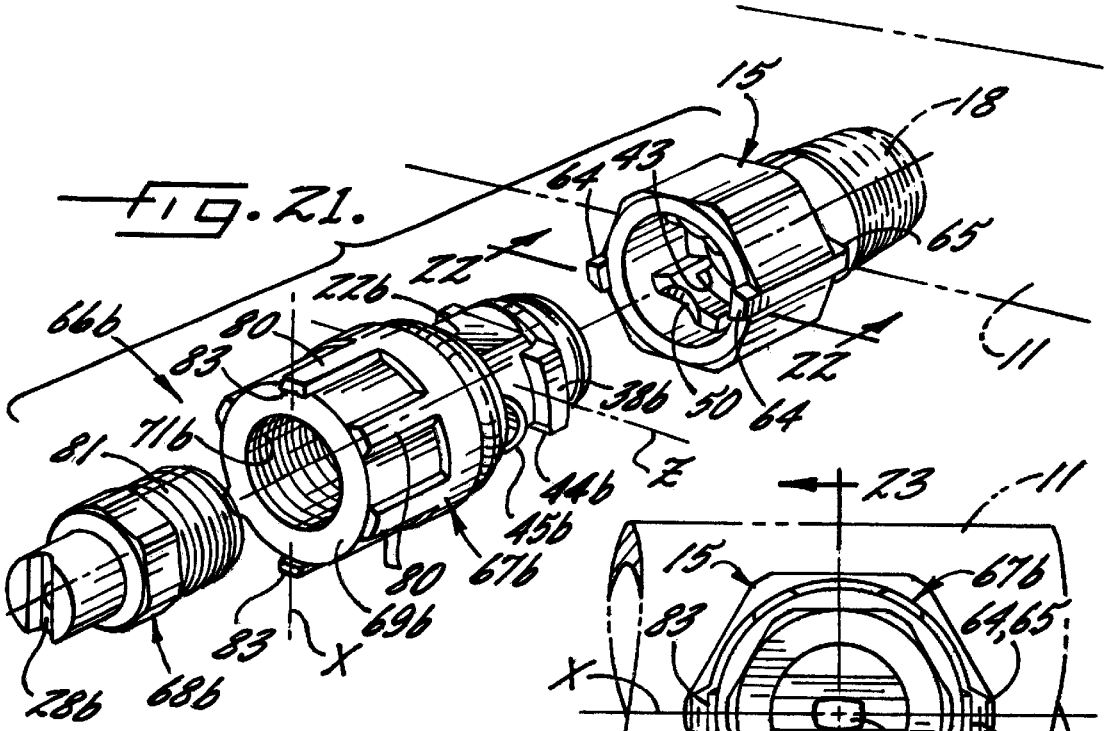
FIG. 21 is an exploded perspective of yet another alternative embodiment of the spray nozzle assembly according to the invention.

In carrying out this aspect of the invention, with only minimal design change, the adapter locking lugs 38*a* are effective for locating and locking the spray nozzle 66 in the body 15 with an X axis of the nozzle adapter 67 parallel to the header 11, such that the whirl spray discharge from the nozzle is directed perpendicularly (i.e., 90 degrees) to the longitudinal axis of the header 11. To this end, as depicted in FIG. 19–20, the stop faces 44*a* of the locking lugs 38*a* of the adapter 67 are laterally offset with respect to the Z axis of the nozzle in the direction of rotation during mounting (herein referred to as "direction of mounting rotation.") a slightly greater distance, than the stop faces 44 of the spray tip 16. In other words, with reference to FIGS. 9 and 14, it can be seen that the stop faces 44 of the spray tip lugs 38 are offset a distance "1" from the Z axis of the spray tip 16 in the direction of mounting rotation, while the stop faces 44*a* of the locking lugs 38*a* of the quick disconnect adapter 67, are located a slightly greater distance "1 plus x" as shown in FIGS. 19 and 20

Figure 14:
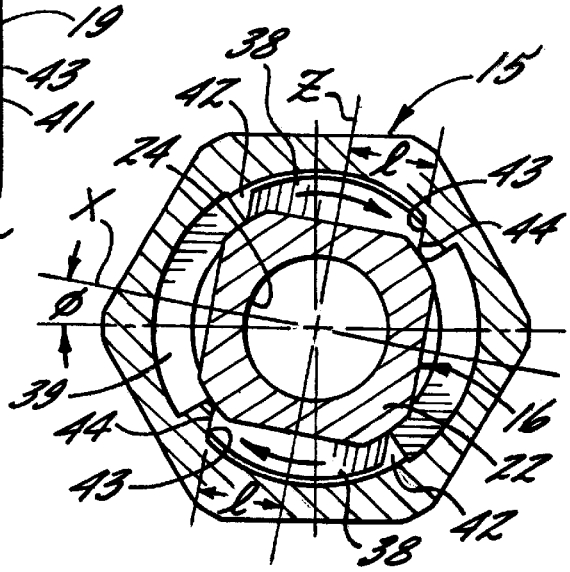
FIG. 14 is a transverse section illustrating engagement of the spray tip locking lug surfaces with the nozzle body, taken in the plane of line 14—14 in FIG. 5.
Figure 15:
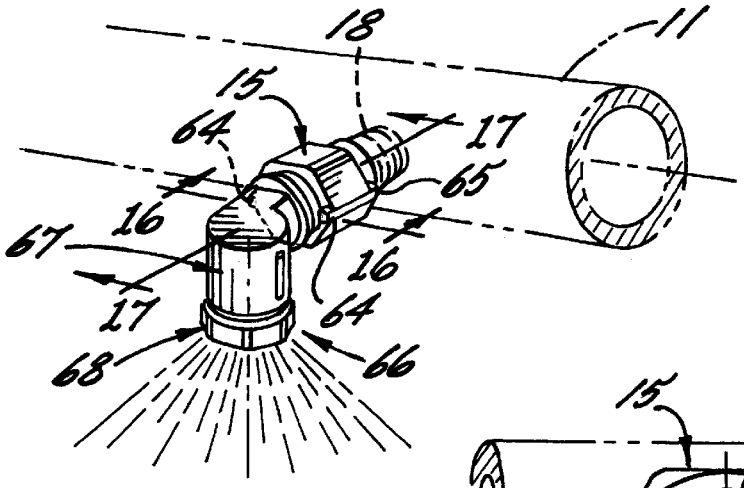
FIG. 15 is a perspective of an alternative embodiment of a spray nozzle assembly according to the invention.
Figure 16:
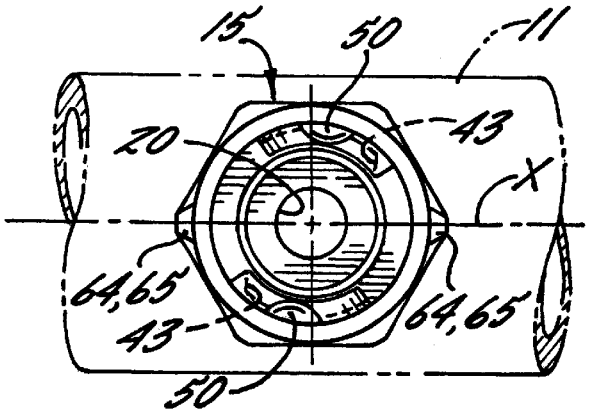
FIG. 16 is a plan view of the nozzle body shown in FIG. 15, taken in the plane of line 16—16.

By reason of the greater lateral offset of the stopping faces 44*a* of the nozzle 66, the lugs 38*a* will engage the stop walls 43 of the body 15 sooner than the lugs 38 of the spray tip 16. As can be seen in FIG. 14, the spray tip 16 is rotated within the body 15 until the lug stop faces 44 come into substantially face-to-face mating engagement with the body stop walls 43. By reason of the greater lateral offset of the lug stop faces 44*a* in a nozzle 66, as seen in FIG. 20, the lug stop faces 44*a* will make contact with the body stop walls 43 prior to coming into complete face-to-face engagement, such that the lug stop faces 44*a* are in angular engaging relation with the body stop walls 43. By appropriate design of the additional lateral offset "x" for the nozzle 66, one skilled in the art will appreciate that rotational mounting of the nozzle 66 can be stopped with the X axis of the nozzle 66 parallel to the longitudinal axis of the supply header 11, rather than at a 10 degree offset as in the case of the spray tip 16. Since the whirl chamber discharge orifice 28*a* is designed to direct the discharging spray at a 90 degree angle to the X axis, upon mounting of the quick disconnect adapter 67 in the body, the discharge orifice 28*a* is automatically oriented for discharging the spray perpendicularly to the liquid supply header 11. Since the additional offset distance "x" may be relatively small, such as on the order of 0.056 inches, the adapter detents 45*a* still engage the body detents 50 sufficiently to positively retain the quick disconnect adapter 67 in mounted position.

Hence, it will be understood by one skilled in the art, that the common body 15, when mounted on the header 11 with its indicator nibs 64, 65 aligned with the axis of the header 11, can receive and orient a spray tip 16 with the elongated flat spray discharge orifice 28 offset at a relatively small angle, such as 10 degrees from the header axis, or alternatively, can receive a second nozzle, such as the nozzle 66, with the discharging spray directed at a different angle, such as 90 degrees to the axis of the header. Since the locking lugs 38, 38*a* and stop walls 44, 44*a* of both the spray tip 16 and adapter 67 are oriented parallel to a similar Z axis of the tip or adapter, both designs facilitate plastic injection molding of the parts, by permitting tooling to be withdrawn from the molds without interference by undercut surfaces or the like. Moreover, since the differences in locking lug design are small, substantially similar tooling may be employed.

Referring now to FIGS. 21–24, there is shown an alternative embodiment of a spray nozzle assembly which lends itself to economical manufacture and use with a multiplicity of different standard spray tips, wherein items similar to those described above have been given similar reference numerals with the distinguishing suffix "b" added. This spray nozzle assembly includes a nozzle body 15 and a removable and replaceable spray nozzle 66*b*. The nozzle body 15, which is identical to the nozzle bodies of the previous embodiments, is similarly mounted on a liquid supply header 11 with the indicator nibs 64, 65 thereof in aligned relation to the longitudinal axis of the header 11. The spray nozzle 66*b* in this case includes a quick disconnect adapter 67*b* having an upstream mounting or end portion 22*b* with camming lugs 38*b* and detents 45*b* similar to the mounting end portion 22 of the spray tip 16 described above. The adapter 67*b* has a downstream end 69*b* formed with a plurality of longitudinally and circumferentially spaced gripping ribs 80 to facilitate handling and rotational mounting of the adapter 67*b* in the body 15.

Pursuant to an important aspect of this embodiment of the invention, the adapter 67*b* is designed to accommodate any of a plurality of standard spray tip inserts 68*b* for the desired spray application. To this end, the downstream end of the adapter is formed with an internally threaded chamber 71*b* which communicates with an upstream internal fluid passageway bore 24*b* of the adapter 67*b* and which is designed to receive the threaded shank 81 of a standard spray tip insert 68*b*. Since any desired spray tip insert 68*b* may be assembled into the adapter 67*b*, the spray nozzle assembly may be easily adaptable for particular applications, utilizing the common nozzle body 15 and adapter 67*b*. It will also be appreciated that while the body 15 and adapter 67*b* preferably are molded of plastic, the spray tip insert 68*b* may be either plastic or metal as the need arises.

Figure 22:
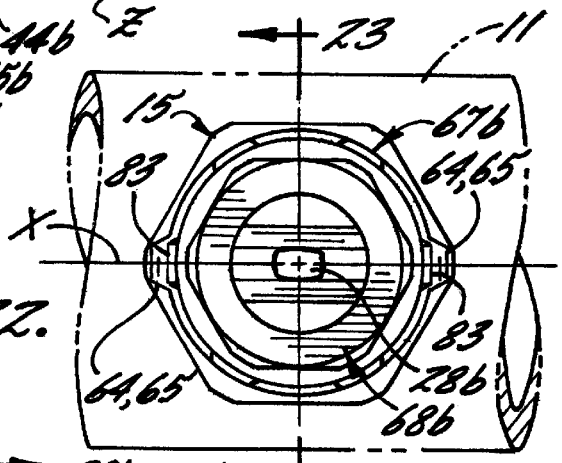
FIG. 22 is the plane view of the nozzle body and spray tip adapter included in the spray nozzle assembly shown in FIG. 21, taken in the plane of line 22—22.
Figure 23:
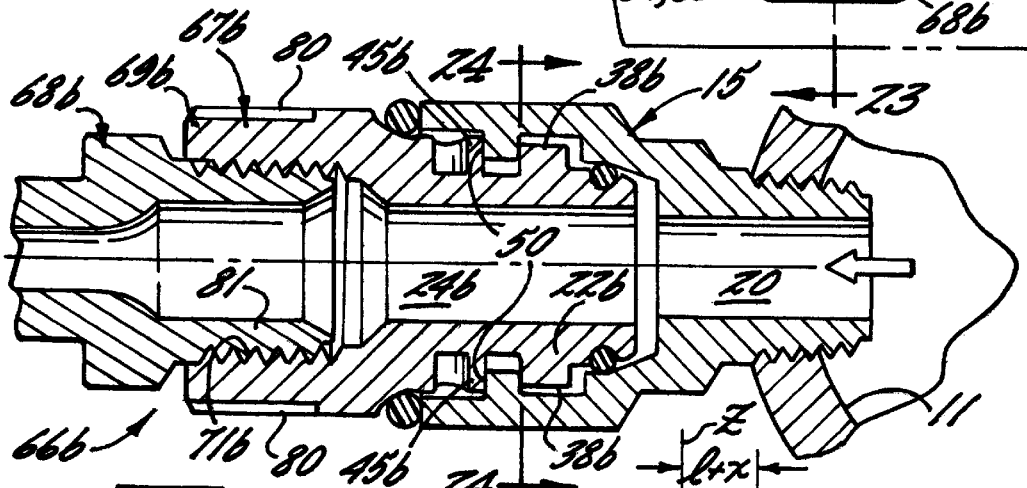
FIG. 23 is an enlarged longitudinal section of the spray nozzle assembly shown in FIG. 22, taken in the plane of line 23—23.
Figure 24:
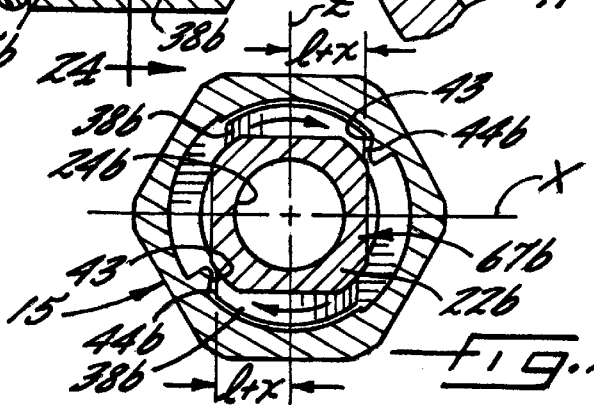
FIG. 24 is a transverse section illustrating engagement of the locking lug and stop surfaces of the spray tip adapter and nozzle body, taken in the plane of line 24—24 in FIG. 23.
Figure 25:
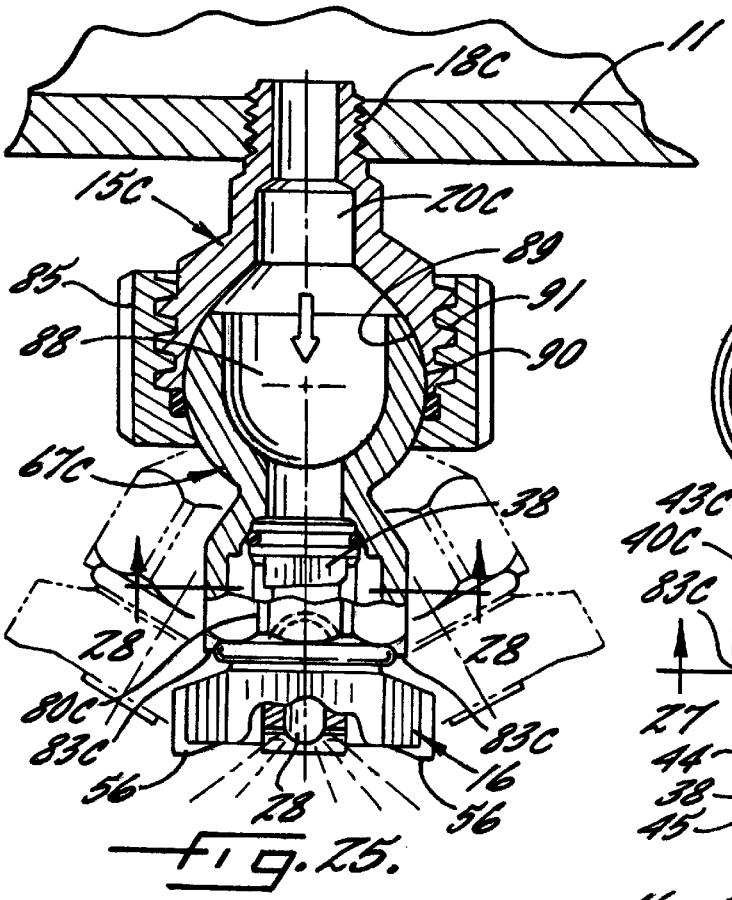
FIG. 25 is a fragmentary section of a further alternative embodiment of the spray nozzle assembly according to the invention.
Figure 26:
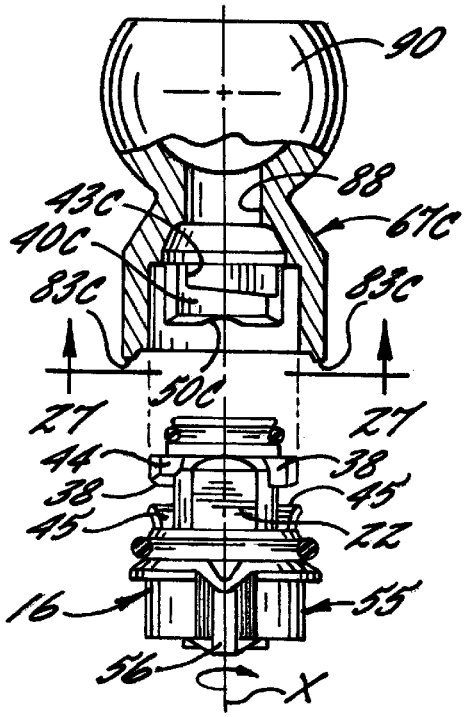
FIG. 26 is an exploded perspective, partially in section, of the spray tip and adapter of the spray nozzle assembly shown in FIG. 25.

In further carrying out this embodiment of the invention, to facilitate predetermined orientation of the discharge orifice 28*b* of the selected spray tip insert 68*b* in the spray nozzle assembly, the adapter 67*b* is formed with indicators 83, which in this case are defined by axial extensions of diametrically opposed gripping ribs 80. The adapter 67*b* is designed such that when rotated into its mounted position in the body 15, the adapter indicators 83 are in aligned relation X to the body indicator nibs 64, 65 (FIG. 22). It will be appreciated that by reason of such indicators 64, 65, 83, prior to mounting of the nozzle 66*b* in the body 15, the spray tip insert 68*b* may be screwed into the body with the discharge orifice 28*b* in predetermined orientation to the adapter indicators 83, which in turn will establish the orientation of the spray tip discharge orifice 28*b* relative to the nozzle body 15 and the liquid supply header 11. In this instance, similar to the spray tip 16 described above, the locking lug surfaces 44*b* of the adapter come into mating engagement with the body stop walls 43, as shown in FIG. 24. Not only does such nozzle assembly enable easy and precise orientation of the spray tip insert discharge orifice 28*a*, many different types of standard spray tip inserts 68*b* may be economically used, without the costly individualized design and tooling.

Referring now to FIGS. 25–28, there is shown a swivel mounted quick disconnect spray nozzle assembly according to the invention, again mounted in depending relation to a liquid supply header 11, wherein parts or elements similar to those described above have been given similar reference numerals with the distinguishing suffix "c" added. The spray nozzle assembly in this case comprises a body 15*c*, an adapter 67*c* mounted for selective swivel positioning within the body 15*c*, a quick disconnect spray tip 16 mounted in the adapter 67*c*, and a retaining cap 85 for removably retaining the adapter 67*c* in desired mounted position in the body. The nozzle body 15*c* is mounted on the underside of the fluid supply header 11 with an upstanding nipple 18*c* positioned within the header 11. For permitting free passage of the liquid from the header 11 to the spray tip 16, the body 15*c* and adapter 67*c* are formed with communicating passages 20*c*, 88.

To enable selective swivel positioning of the adapter 67*c* relative to the body, the body 15*c* is formed with a ball shaped socket 89 on its underside for receiving a ball shaped mounting end 90 of the adapter 67*c*. For retaining the adapter 67*c* in selective position, the retaining cap 85 is threadedly engageable with an externally threaded section 91 of the body 15*c*. To facilitate handling and manipulation of the adapter 67*c*, the adapter 67*c* is formed with a plurality of circumferentially spaced longitudinal gripping ribs 80*c*. In order to permit quick disconnect mounting of the spray tip 16 in the adapter 67*c*, the adapter 67*c* and spray tip 16 are formed with cooperating camming lugs 40*c*, 38 and detents 50*c*, 45 similar to the nozzle body 15 and spray tip 16 described above. Indeed, the spray tip may be identical to the previously described spray tip 16.

Figure 27:
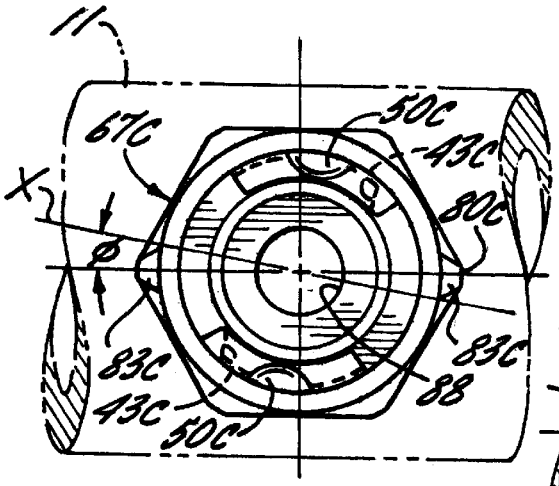
FIG. 27 is a plan view of the nozzle body shown in FIG. 26, taken in the plane of line 27—27.
Figure 28:
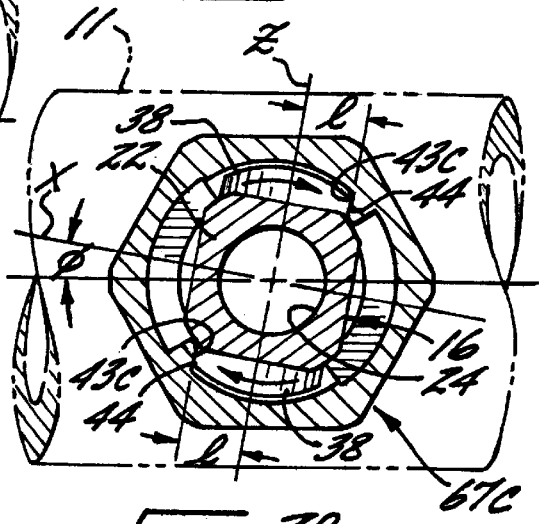
FIG. 28 is a transverse section illustrating engagement of the locking surfaces of the spray tip and adapter shown in FIG. 25, taken in the plane of line 28—28.

In carrying out this embodiment of the invention, to enable assembly of the spray tip 16 in predetermined angular relation to the liquid supply header 11, the adapter 67*c* is formed with indicators 83*c*, in this case defined by axial extensions of two of the diametrically opposed gripping ribs 80*c* The adapter 67*c* and spray tip 16 are designed such that upon mounting of the spray tip 16 in the adapter 67*c*, the discharge orifice 28 of the spray tip 16 is in predetermined angular relation to the indicator nibs 83*c* of the adapter 67*c*, such as a 10 degree offset. Hence, securing the adapter 67*c* in the body 15*c* with the indicator nibs 83*c* in aligned relation with the liquid supply header 11 as shown in FIG. 27, will automatically locate the discharge orifice 28 of the spray tip 16, upon mounting in the adapter 67*c*, in predetermined angular relation to the header 11 (FIG. 28).

From the foregoing it can be seen that the spray nozzle assembly of the present invention may be quickly and accurately mounted in predetermined angular orientation relative to a supply pipe or header and enable a user to easily observe the proper orientation of the discharge orifice of the spray tip prior to the spray operation. When the spray tip includes gripping wings, they provide an easily observable indication of the discharge orifice orientation, while neither impeding the discharging flat spray pattern nor the inward flow of ambient air necessary for enhanced liquid particle breakdown and distribution. The spray tip further is designed for economical manufacture and expendable use and can be mounted for effective spraying in either downward or upward directions relative to a liquid supply header or pipe. The inventive spray nozzle assembly further can be economically adapted for various spray applications, with the fluid directing spray tip or nozzle being easily mounted and replaced in predetermined orientation with respect to the liquid supply header.

What is claimed is:

1. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern in a line along said long axis, said spray tip having radial wings extending outwardly of said spray tip for facilitating rotation of said spray tip relative to said body, and said wings being disposed in radial alignment with the long axis of said elongated discharge orifice for providing a visual indication of the orientation of said discharge orifice without direct viewing thereof.

2. The spray nozzle assembly of claim 1 in which said wings extend axially downstream a distance beyond said discharge orifice.

3. The spray nozzle assembly of claim 1 in which said spray tip includes a fluid conduit portion within which said discharge orifice is disposed and a gripping portion disposed in surrounding spaced relation to said conduit portion, said gripping portion being formed with said wings.

4. The spray nozzle assembly of claim 3 in which said wings are disposed on diametrically opposed portions of said gripping portion and are interconnected by diametrically opposed cylindrical walls.

5. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip having radial wings extending outwardly of said spray tip for facilitating rotation of said spray tip relative to said body, said wings being disposed in radial alignment with the long axis of said elongated discharge orifice for providing a visual indication of the orientation of said discharge orifice without direct viewing thereof, and said wings defining clearance openings disposed adjacent diametrically opposed ends of said elongated discharge orifice for permitting discharge of a flat spray pattern without interference from said wings.

6. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip having radial wings extending outwardly of said spray tip for facilitating rotation of said spray tip relative to said body, said wings being disposed in radial alignment with the long axis of said elongated discharge orifice for providing a visual indication of the orientation of said discharge orifice without direct viewing thereof, said spray tip having radial outwardly extending locking elements operable for securing said spray tip to said nozzle body, and said wings and spray tip locking elements being circumferentially offset 90 degrees relative to each other.

7. The spray nozzle assembly of claim 6 in which said spray tip locking elements include camming lugs extending outwardly on diametrically opposed sides of said spray tip.

8. The spray nozzle assembly of claim 7 in which said locking elements include detents disposed on diametrically opposed sides of said spray tip.

9. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip having radial wings extending outwardly of said spray tip beyond said nozzle body for facilitating rotation of said spray tip relative to said body, said wings being disposed in radial alignment with the long axis of said elongated discharge orifice for providing a visual indication of the orientation of said discharge orifice without direct viewing thereof, and said wings defining fluid passageways extending through the wings at locations radially outwardly of said nozzle body.

10. A spray nozzle assembly comprising a nozzle body, a spray tip adapted for releasable securement to said body as an incident to rotation of said spray tip relative to said body, said spray tip having a discharge orifice, said spray tip having-radially projecting locking elements on diametrically opposed sides for securing said spray tip to said nozzle body in predetermined angular orientation with respect to said nozzle body, said spray tip having radial gripping wings extending outwardly of said spray tip on diametrically opposed sides thereof for facilitating rotation of said spray tip relative to said body, and said wings and spray tip locking elements being circumferentially offset 90 degrees to each other.

11. The spray nozzle assembly of claim 10 in which said spray tip locking elements include camming lugs extending outwardly on diametrically opposed sides of said spray tip.

12. The spray nozzle assembly of claim 10 in which said locking elements include detents disposed on diametrically opposed sides of said spray tip.

13. The spray nozzle assembly of claim 10 in which said wings define passages extending axially through the spray tip on opposite sides of said nozzle body.

14. A spraying system comprising a longitudinally extending fluid supply header, a spray nozzle assembly mounted on said header for spraying liquid directed through said header, said spray nozzle assembly including a nozzle body fixed to said header in fluid communication therewith, a spray tip releasably secured to said body as an incident of rotation of said spray tip relative to said body, said spray tip having an elongated discharge orifice oriented along a long transverse axis and adapted for emitting a flat spray pattern, said spray tip having radial gripping wings extending outwardly of said spray tip for facilitating rotation of said spray tip relative to said body during assembly and disassembly, and said wings being disposed in radial alignment with the long axis of said elongated discharge orifice, and said elongated discharge orifice and said aligned wings being oriented at an acute angle to a longitudinal axis of said header.

15. The spraying system of claim 14 in which said wings define clearance openings disposed adjacent diametrically opposed ends of said elongated discharge orifice for permitting discharge of a flat spray pattern without interference from said wings.

16. The spraying system of claim 14 in which said wings define passages extending axially through the spray tip on opposite sides of said elongated discharge orifice.

17. The spraying system of claim 16 in which said passages are disposed radially outwardly of said nozzle body.

18. The spraying system of claim 14 in which said spray tip has radial outwardly extending locking elements operable for securing said spray tip to said nozzle body, and said wings and spray tip locking elements being circumferentially offset 90 degrees relative to each other.

19. The spraying system of claim 14 in which said nozzle body includes a pair of axially aligned indicators, said nozzle body being mounted on said header with said indicators in longitudinal alignment with said header, and said spray tip discharge orifice being oriented with the long axis thereof at a predetermined acute angle to said header when secured to said body.

20. The spraying system of claim 19 in which said nozzle body includes pairs of diametrically opposed indicators on top and bottom sides thereof each disposed in longitudinal alignment with said header.

21. The spraying system of claim 19 in which said indicators are raised nibs integrally formed on said nozzle body.

22. The spraying system of claim 14 in which said spray tip has diametrically opposed outwardly extending radial gripping wings in aligned relation to the long axis of said discharge orifice for indicating the orientation of the discharge orifice without direct viewing thereof.

23. A spraying system comprising a longitudinally extending fluid supply header, a plurality of spray nozzle assembly mounted on said header for spraying liquid directed through said header, said spray nozzle assemblies each including a nozzle body fixed to said header in fluid communication therewith, a spray tip releasably secured to said body as an incident to rotation of said spray tip relative to said body to a fully assembled position, said spray tip of each nozzle assembly having an elongated discharge orifice oriented along a respective long transverse axis and adapted for emitting a flat spray pattern, said nozzle body of each spray nozzle assembly having a single pair of diametrically opposed indicators on at least one axial end thereof, said nozzle bodies being mounted on said header with said indicators in longitudinal alignment with said header, and said elongated discharge orifice of the spray tip of each nozzle assembly being oriented at a similar predetermined relatively small angle to a longitudinal axis of said header when in said fully assembled position.

24. The spraying system of claim 23 in which each said nozzle body includes pairs of diametrically opposed indicators on top and bottom sides thereof with each pair being disposed in longitudinal alignment with said header.

25. The spraying system of claim 23 in which said indicators are raised nibs integrally formed on said nozzle body.

26. The spraying system of claim 23 in which each said spray tip has diametrically opposed outwardly extending radial gripping wings in aligned relation to the long axis of said discharge orifice for indicating the orientation of the discharge orifice without direct viewing thereof.

27. The spraying system of claim 26 in which the gripping wings of each spray tip define clearance openings disposed adjacent diametrically opposed ends of the elongated discharge orifice thereof.

28. The spraying system of claim 23 in which said gripping wings of each spray tip define passages extending axially through the spray tip on opposite sides of the nozzle body.

29. The spraying system of claim 28 in which said gripping wings have a V-shaped cross section which define V-shaped passages extending axially through the spray tip.

30. A spray nozzle assembly for mounting on a longitudinally extending fluid supply header comprising a nozzle body adapted for securement to said header in fluid communication therewith, a spray nozzle including an adapter having a mounting end, said adapter mounting end and nozzle body having cooperating camming and locking elements for releasably securing said adapter to said body as an incident to rotation of said adapter relative to said body, said adapter having a fluid passageway in communication with said nozzle body, said adapter having a threaded-discharge end, and an insert threadedly engageable with the discharge end of said adapter and having an orifice designed for discharging a desired spray pattern.

31. The spray nozzle assembly of claim 30 in which said insert is removable and replaceable in said adapter.

32. The spray nozzle assembly of claim 30 in which said nozzle body has at least one indicator adapted for positioning in alignment with a longitudinal axis of the fluid supply header upon which the nozzle assembly is mounted, and said adapter having at least one indicator which is positionable into aligned relation with the nozzle body indicator as an incident to rotating said adapter into mounted position with said body.

33. The spray nozzle assembly of claim 32 in which said insert is screwed into said adapter with said orifice in predetermined orientation with respect to said adapter indicator.

34. The spray nozzle assembly of claim 33 in which said insert defines an elongated discharge orifice for generating a flat spray pattern, and said insert is screwed into said adapter with a long axis of said orifice disposed in predetermined angular relation to said adapter indicator.

35. A spray nozzle assembly for mounting on a longitudinally extending fluid supply header comprising a body adapted for securement to said header in fluid communication therewith, an adapter mounted for selective swivel positioning in the body, a spray tip having a mounting end, said adapter and spray tip mounting end having cooperating locking elements for releasably securing the spray tip in mounted position to said adapter as an incident to rotation of the spray tip relative to said adapter, and said spray tip having a discharge orifice that is automatically positionable into predetermined relation to the adapter indicator as an incident to rotation of the spray tip to mounted position in said adapter.

36. The spray nozzle assembly of claim 35 in which said body is formed with a ball shaped socket, and said adapter has a ball shaped mounting end retained in said socket.

37. The spray nozzle assembly of claim 35 in which said adapter is formed with a pair of said indicators.

38. The spray nozzle assembly of claim 37 in which said adapter is formed with a plurality of circumferentially spaced longitudinally extending ribs, and said indicators are defined by extensions of a pair of said ribs that are in diametrically opposed relation to each other.

39. The spray nozzle assembly of claim 35 in which said spray tip has an elongated discharge orifice and is mounted with said discharge orifice in predetermined angular relation to said adapter indicator.

40. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip having radial wings of V-shaped cross section extending outwardly of said spray tip for facilitating rotation of said spray tip relative to said body, and said wings being disposed in radial alignment with the long axis of said elongated discharge orifice for providing a visual indication of the orientation of said discharge orifice without direct viewing thereof.

41. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip having radial wings extending outwardly of said spray tip for facilitating rotation of said spray tip relative to said body, said wings extending axially downstream a distance beyond said discharge orifice, and said wings being disposed in radial alignment with the long axis of said elongated discharge orifice for providing a visual indication of the orientation of said discharge orifice without direct viewing thereof.

42. The spray nozzle assembly of claim 41 in which said passages are V-shaped.

43. A spray nozzle assembly comprising a nozzle body, a spray tip adapted for releasable securement to said body as an incident to rotation of said spray tip relative to said body, said spray tip having an elongated discharge orifice oriented along a long transverse axis and adapted for emitting a flat spray pattern, said spray tip including a fluid conduit portion within which said discharge orifice is disposed and a gripping portion disposed in surrounding spaced relation to said conduit portion, said gripping portion being formed with radial wings extending outwardly of said spray tip for facilitating rotation of said spray tip relative to said body, said wings being disposed on diametrically opposed portions of said gripping portion and being interconnected by diametrically opposed cylindrical walls, said wings being defined by side walls extending outwardly in cantilevered fashion from said cylindrical walls, and said wings being disposed in radial alignment with the long axis of said elongated discharge orifice for providing a visual indication of the orientation of said discharge orifice without direct viewing thereof.

44. The spray nozzle assembly of claim 43 in which said side walls and cylindrical walls being of substantially uniform thickness.

45. The spray nozzle assembly of claim 43 in which said wing side walls define axial passageways extending through said spray tip on diametrically opposed sides of said discharge orifice.

* * * * *